US007347539B2

(12) United States Patent
Rybicki et al.

(10) Patent No.: US 7,347,539 B2
(45) Date of Patent: Mar. 25, 2008

(54) SYSTEM AND METHOD FOR AUTO-THRESHOLD ADJUSTMENT FOR PHASING

(75) Inventors: Michael J. Rybicki, Downers Grove, IL (US); Andrew Earl Fickling, Mt. Prospect, IL (US)

(73) Assignee: Videojet Technologies Inc., Wood Dale, IL (US)

( * ) Notice: Subject to any disclaimer, the term of this patent is extended or adjusted under 35 U.S.C. 154(b) by 242 days.

(21) Appl. No.: 10/949,605

(22) Filed: Sep. 24, 2004

(65) Prior Publication Data

US 2005/0280676 A1 Dec. 22, 2005

Related U.S. Application Data

(60) Provisional application No. 60/581,239, filed on Jun. 17, 2004.

(51) Int. Cl.
*B41J 2/085* (2006.01)

(52) U.S. Cl. ..... 347/76

(58) Field of Classification Search ..... 347/76, 347/78, 79, 80, 81
See application file for complete search history.

(56) References Cited

U.S. PATENT DOCUMENTS

| | | | |
|---|---|---|---|
| 3,298,030 | A | 1/1967 | Lewis et al. |
| 3,969,733 | A | 7/1976 | Demoss et al. |
| 4,115,787 | A | 9/1978 | Fujimoto et al. |
| 4,198,642 | A | 4/1980 | Gamblin |
| 4,216,480 | A | 8/1980 | Buehner et al. |
| 4,322,732 | A | 3/1982 | Furukawa et al. |
| 4,417,256 | A | 11/1983 | Fillmore et al. |
| 4,439,775 | A | 3/1984 | Johnson |
| 4,472,722 | A | 9/1984 | Ebi |
| 4,613,871 | A | 9/1986 | Katerberg |
| 4,631,557 | A | 12/1986 | Cooke et al. |
| 4,670,761 | A | 6/1987 | Yoshino et al. |
| 4,688,049 | A | 8/1987 | Doyle et al. |
| 4,845,512 | A | 7/1989 | Arway |
| 5,390,290 | A | 2/1995 | Hayashi et al. |
| 5,499,321 | A | 3/1996 | Hayashi et al. |
| 6,109,739 | A | 8/2000 | Stamer et al. |
| 6,447,108 | B1 | 9/2002 | Kassner |

FOREIGN PATENT DOCUMENTS

| | | |
|---|---|---|
| EP | 0 551 763 A1 | 7/1993 |

(Continued)

*Primary Examiner*—K. Feggins
(74) *Attorney, Agent, or Firm*—McAndrews Held & Malloy, Ltd,

(57) ABSTRACT

Certain embodiments provide a system and method for auto-threshold adjustment using a continuous ink jet printer. An embodiment of a system includes a nozzle for producing ink drops from an ink stream, a sensor positioned with respect to the nozzle for measuring charge from the ink drops to generate a charge signal, a peak detector for detecting peaks in the charge signal, and a threshold storage device for adjusting the threshold based on a number of detected peaks. In an embodiment, the threshold storage device stores the threshold. The threshold storage device may be a digital potentiometer, for example. The system may also include a comparator comparing the charge signal to the threshold. The comparator may select between the threshold and a standard reference signal to compare to the charge signal.

19 Claims, 5 Drawing Sheets

FOREIGN PATENT DOCUMENTS

| | | |
|---|---|---|
| EP | 0 690 411 A2 | 1/1996 |
| EP | 0 741 041 A2 | 11/1996 |
| JP | 54 104346 | 8/1979 |
| JP | 60 112454 | 6/1985 |
| JP | 61 079671 | 4/1986 |
| WO | WO 93/10977 | 6/1993 |
| WO | WO 97/06009 | 2/1997 |

SYSTEM AND METHOD FOR AUTO-THRESHOLD ADJUSTMENT FOR PHASING

RELATED APPLICATIONS

The present application relates to, and claims priority from, U.S. Provisional Application No. 60/581,239 filed on Jun. 17, 2004, and entitled "System and Method for Auto-Threshold Adjustment for Phasing".

FEDERALLY SPONSORED RESEARCH OR DEVELOPMENT

[Not Applicable]

MICROFICHE/COPYRIGHT REFERENCE

[Not Applicable]

BACKGROUND OF THE INVENTION

The present invention relates to ink jet printing, and in particular to an improved system and method for auto-threshold adjustment for phasing in an ink jet printer.

Continuous ink jet printers are well known in the field of industrial coding and marking, and are widely used for printing information, such as expiry dates, on various types of substrate passing the printer on production lines. As shown in FIG. 1, a jet of ink is broken up into a regular stream of uniform ink drops by an oscillating piezoelectric element. The drops then pass a charging plate, which charges individual drops at a selected voltage. The drops then pass through a transverse electric field provided across a pair of deflection plates. Each drop is deflected by an amount which depends on its charge. If the drop is uncharged, it will pass through the deflection plates without deflection. Uncharged and slightly charged drops are collected in a catcher and returned to the ink supply for reuse. A drop following a trajectory that misses the catcher will impinge on the substrate at a point determined by the charge on the drop. Often, each charged drop is interspersed by a guard drop with substantially no charge to decrease electrostatic and aerodynamic interaction between charged drops. As the substrate is moving past the printer, the placement of the drop on the substrate in the direction of motion of the substrate will have a component determined by the time at which the drop is released. The direction of motion of the substrate will hereinafter be referred to as the horizontal direction, and the direction perpendicular to this, in the plane of the substrate will hereinafter be referred to as the vertical direction. These directions are unrelated to the orientation of the substrate and printer in space. If the drops are deflected vertically, the placement of a drop in the vertical and horizontal direction is determined both by the charge on the drop and the position of the substrate.

It is general practice to provide predefined raster patterns, with the matrix for each pattern, customarily representing a character, of a predetermined size. For example, a 5 high by 5 wide matrix representing an image, as shown in FIG. 2, can be created which represents a whole image such as a character or a portion of an image. FIG. 3 shows a 7 by 9 matrix which yields better defined characters. A technique which has become widely used for printing these characters or portions of images is disclosed in U.S. Pat. No. 3,298,030 (Lewis et al). A stroke is defined for each column of the matrix and represents a slice of the image. Each usable drop is assigned to each pixel (dot position) in the stroke. If the pixel is a blank pixel, then the drop is not charged and is captured by the catcher to be sent back to the ink supply. If the pixel is to be printed, an appropriate charge is put on the drop so that it is deflected to follow a trajectory that intercepts the substrate at the appropriate position in the column for that stroke. This cycle repeats for all strokes in a character and then starts again for the next character. If the drops are deflected transversely to the direction of travel of the substrate, a set of drops forming a stroke will clearly lie along a diagonal line, as the substrate will move a certain distance between each drop in the stroke. The angular deviation of the line from vertical will increase with the speed of the substrate relative to the drop emission rate. This angular deviation can be counteracted by angling the deflection plates away from the vertical direction by an amount dependent on the expected speed of the substrate. If drops in a stroke are not sequentially allocated to equally spaced positions on the substrate, the points will no longer lie along a straight line.

In order to maintain a simple matrix raster pattern, with straight lines in any direction in the matrix mapping onto straight lines on the substrate, it is necessary to print drops in a stroke sequentially with an equal time interval between each stroke. A stroke takes the same time whether it contains one printed drop or five printed drops. Generally, a varying number of extra guard drops are used at the end of each stroke to permit variation in the substrate speed on a stroke by stroke basis.

Current systems may generate feedback for ink drop charging by measuring peaks of a charge signal obtained from an ink stream. Systems often employ a threshold against which to compare the charge signal. In current systems, the threshold is physically set at a certain trip point, and anything above that trip point is a "good" phase. Sensors used to obtain charge signal data for an ink stream are placed in an ink catcher and are often physically adjusted to acquire data. This process is inconvenient, time-consuming, and inaccurate for printer users. System configurations and thresholds must be changed manually for different inks, printers, and environments. Additionally, positioning a sensor in the ink catcher introduces additional interference in charge measurements due to the catcher and distance from a nozzle originating the ink stream. Furthermore, it is difficult to isolate individual ink drops in the ink catcher. Thus, there is a need for an improved system and method for measuring charge and setting thresholds in an ink printing system.

There is a need for an improved system and method for auto-threshold adjustment for phasing in an ink jet printer.

BRIEF SUMMARY OF THE INVENTION

Certain embodiments provide a system and method for auto-threshold adjustment using a continuous ink jet printer. An embodiment of a system includes a nozzle for producing ink drops from an ink stream, a sensor positioned with respect to the nozzle for measuring charge from the ink drops to generate a charge signal, a peak detector for detecting peaks in the charge signal, and a threshold storage device for adjusting the threshold based on a number of detected peaks.

In an embodiment, the threshold storage device stores the threshold. The threshold storage device may be a digital potentiometer, for example. The system may also include a comparator comparing the charge signal to the threshold. The comparator may select between the threshold and a standard reference signal to compare to the charge signal. A selector may be used to select between the threshold and the standard reference signal. The system may also include filter electronics for filtering the charge signal. A second sensor may also be positioned with respect to an ink catcher for measuring charge from the ink drops to generate a second charge signal.

An embodiment of a method for adaptive thresholding includes detecting a charge on at least one ink drop, generating a charge signal based on the charge, and adjusting a signal threshold based on the charge signal. The method may also include measuring peaks in the charge signal. A charge phase may be selected for printing based on the signal threshold. The signal threshold may be stored. In an embodiment, the method includes comparing the signal threshold to a charge signal. The method may include selecting between the signal threshold and a reference threshold for comparison to the charge signal.

The method may also include generating a second charge signal based on charge on the at least one ink drop. Additionally, the method may include measuring a time of travel for at least one ink drop based on the charge signals. The method may further include determining a point at which a minimum nozzle drive produces a maximum amplitude in the charge signal.

An embodiment of a system for dynamic threshold adjustment in a phasing feedback unit includes a sensor for measuring a charge on an ink drop, a detection unit for dynamically adjusting a signal comparison threshold based on the charge, and a comparator for comparing a charge phase signal to the signal comparison threshold. The system may include a plurality of sensors obtaining charge data for the ink drop at a plurality of locations. In an embodiment, the detection unit selects a phase for charging the ink drop.

Figure 1:
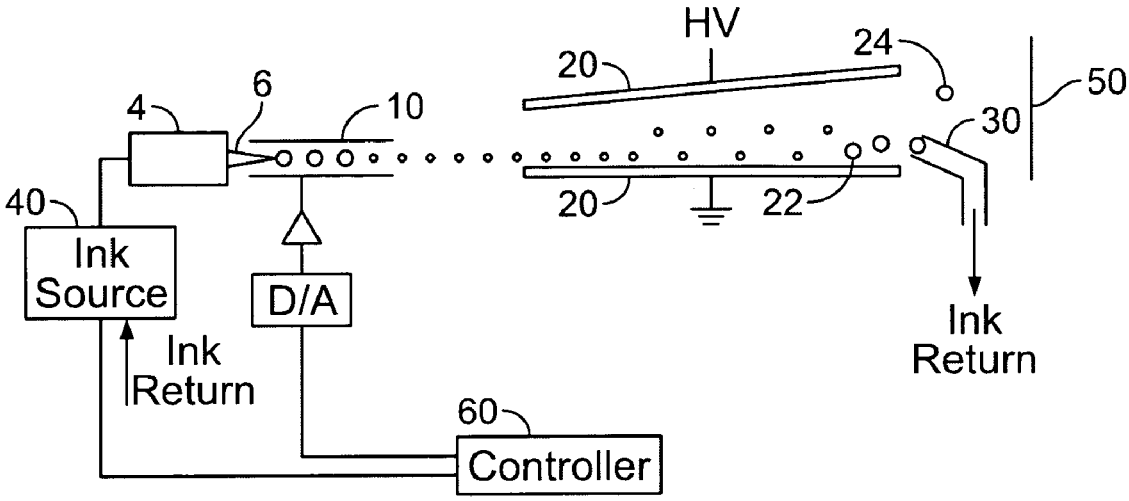
FIG. 1 shows the operation of a typical continuous ink jet printer.
Figure 2:
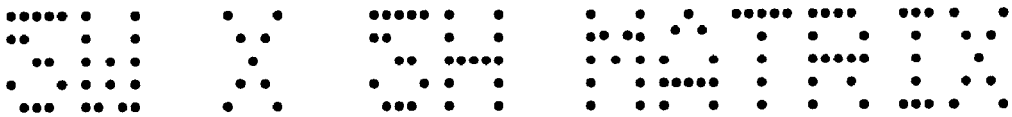
FIG. 2 illustrates characters from a typical 5×5 font used by continuous ink jet printers.
Figure 3:
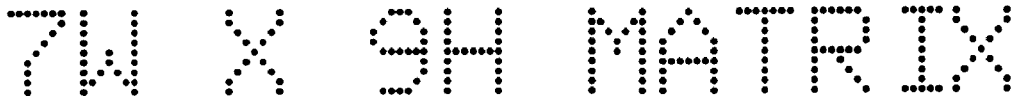
FIG. 3 illustrates characters from a standard 7×9 font used by known continuous ink jet printers.

The foregoing summary, as well as the following detailed description of the preferred embodiments of the present invention, will be better understood when read in conjunction with the appended drawings. For the purpose of illustrating the preferred embodiments of the present invention, there is shown in the drawings, embodiments which are presently preferred. It should be understood, however, that the present invention is not limited to the arrangements and instrumentality shown in the attached drawings.

DETAILED DESCRIPTION OF THE INVENTION

According to an embodiment shown in FIG. 1, a continuous ink jet printer 1 includes a print head with a drop generator 4 which receives ink from an ink source 40. The drop generator incorporates a piezoelectric oscillator which creates perturbations in the ink flow at a nozzle 6. Regular sized and spaced drops are accordingly emitted from the nozzle. The drops pass through a charging tunnel 10, where a different charge can be applied to each drop. This charge determines the degree of deflection as the drop passes between a pair of deflection plates 20 between which a substantially constant electric field is maintained. Uncharged or slightly charged drops 22 pass substantially undeflected to a catcher 30, and are recycled to ink source 40. Charged drops 24 are projected toward a substrate 50 and are deflected so as to have a trajectory striking the latter which moves past the print head in the horizontal direction. The level of charge applied to the drop controls its vertical displacement/position on the substrate.

The charge to be applied to a drop is determined by a controller 60, which may be implemented by a device such as a general purpose processor, microprocessor, microcontroller, or embedded controller having appropriate input and output circuitry, as is well known in the art. The controller 60 operates under general program control of the instructions stored in an associated memory. The memory generally includes a section of nonvolatile memory (e.g., flash memory, hard disk memory, EEPROM, and the like) and volatile memory (e.g., RAM). The controller 60 is programmed to deliver control signals to the charge tunnel 10 to control the charges applied to the individual drops as they pass through the charge tunnel 10. One suitable microprocessor is a model DS 80C310 microprocessor as is available from Dallas Semiconductor of Dallas Tex.; however, numerous other commercially available devices could readily be adapted to perform the functions of the controller 60.

Figure 4:
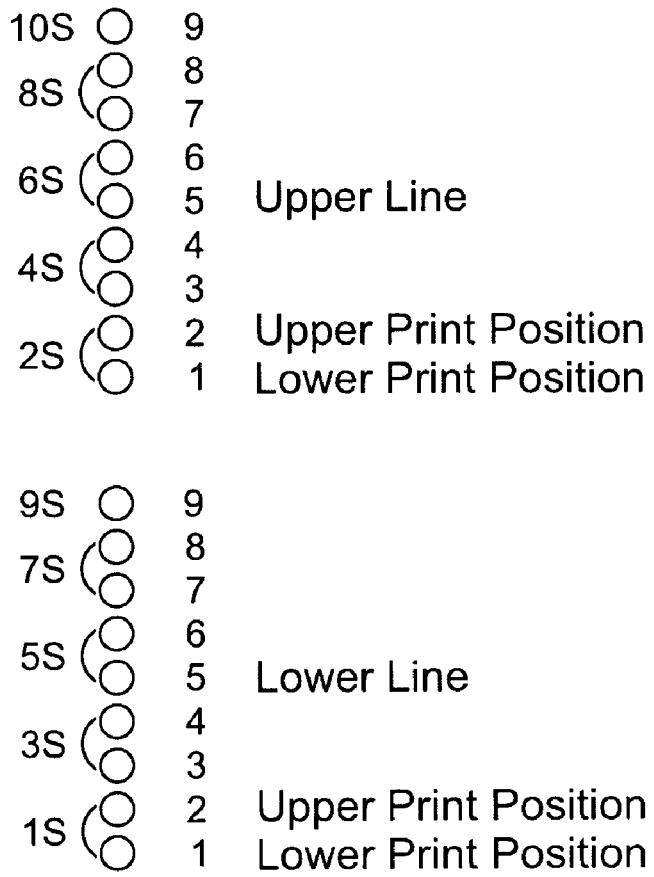
FIG. 4 illustrates a method of printing two lines of print in accordance with a specific embodiment of the present invention.
Figure 5:
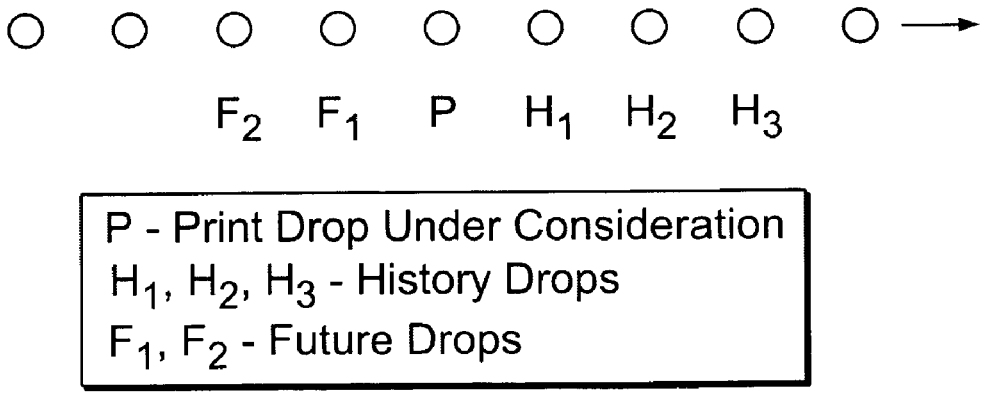
FIG. 5 illustrates a data window that may be used in a specific embodiment of the present invention.

With reference to FIGS. 4 and 5, drops are charged and printed in accordance with a stroke-based method, wherein each stroke or column is divided into N virtual print positions of which only n of said positions are allowed to be used as active print positions in the column, where N>n. When, as shown in FIG. 4, a stroke includes multiple lines of print, each line of print is divided into N virtual print positions, of which only n of the virtual print positions are allowed to be used as active print positions in the print line, where N>n. In the specific embodiment shown in FIG. 4, there are two lines of print, each of which has 9 virtual print positions (N=9), of which only 5 (n=5) of the positions are allowed to be used as active print positions in any given stroke.

At least some of the N virtual print positions are divided into pairs of adjacent print positions, wherein each pair of adjacent positions includes a first (e.g., lower) print position and a second (e.g., upper) print position. In single-line print applications, only one print position per pair, i.e., either the upper or lower print position, is typically used in any given stroke so as to reduce the effect of electrostatic interaction between print drops. When a stroke contains multiple lines of print, the drops may be printed in both positions of a given pair of adjacent print positions by printing the drops in an alternating ascending ramp, as is discussed below. Printing in an alternating ascending ramp reduces the effect of electrostatic interaction between the drops.

Each line of print in the example of FIG. 4 has an odd number (N=9) of virtual print positions. Hence, there are actually eight sets of adjacent pairs (numbered 1*s* to 8*s*) and two unpaired print positions (numbered 9*s* and 10*s*). In the illustrated embodiment, the uppermost print position in each line is unpaired; however, it will be appreciated that this arrangement is merely an exemplary, non-limiting example.

The reference numerals 1*s* to 10*s* are used to designate the print order during a stroke. In the following description, these positions will be referred to as stroke positions, e.g., the "first stroke position 1*s*." As is shown in FIG. 4, the drops may be printed in an alternating ascending ramp sequence (specifically, 1*s* to 10*s*), wherein the drops in a given stroke are printed from alternating print lines in the stroke and from lowest position, i.e., charge potential, to highest position within each line of print. Printing in an alternating ascending ramp sequence increases the vertical distance on the substrate between adjacent drops in the stream, thereby drastically reducing the electrostatic interaction.

As described above, the charge tunnel 10 is a device that applies a charge to an ink droplet as it passes through the tunnel 10. To be charged, an ink drop separates from an ink stream within the charge tunnel 10. A print drop voltage is applied to the charge tunnel 10 to charge the ink drop. For example, the print drop voltage may be applied to the charge tunnel 10 on a falling edge of a software-selectable phase clock.

Phasing is a method of determining an optimum time to output a charge to the charge tunnel 10 to allow the maximum charge to be placed on an ink drop. Several methods have been used to determine an optimum time, such as a moving window phase system. A phasing system outputs phase drops at different phase clocks and determines charge on phase drops (i.e., drops that are charged at a phase voltage) as the drops arrive at the ink catcher 30. For example, a phasing sense amp detector may be located in the catcher 30 to determine charge on non-printed ink drops. Based upon signals determined at the catcher 30, the phasing system determines with which phase to print and whether or not the printer is charging drops to the desired level(s).

Figure 6:
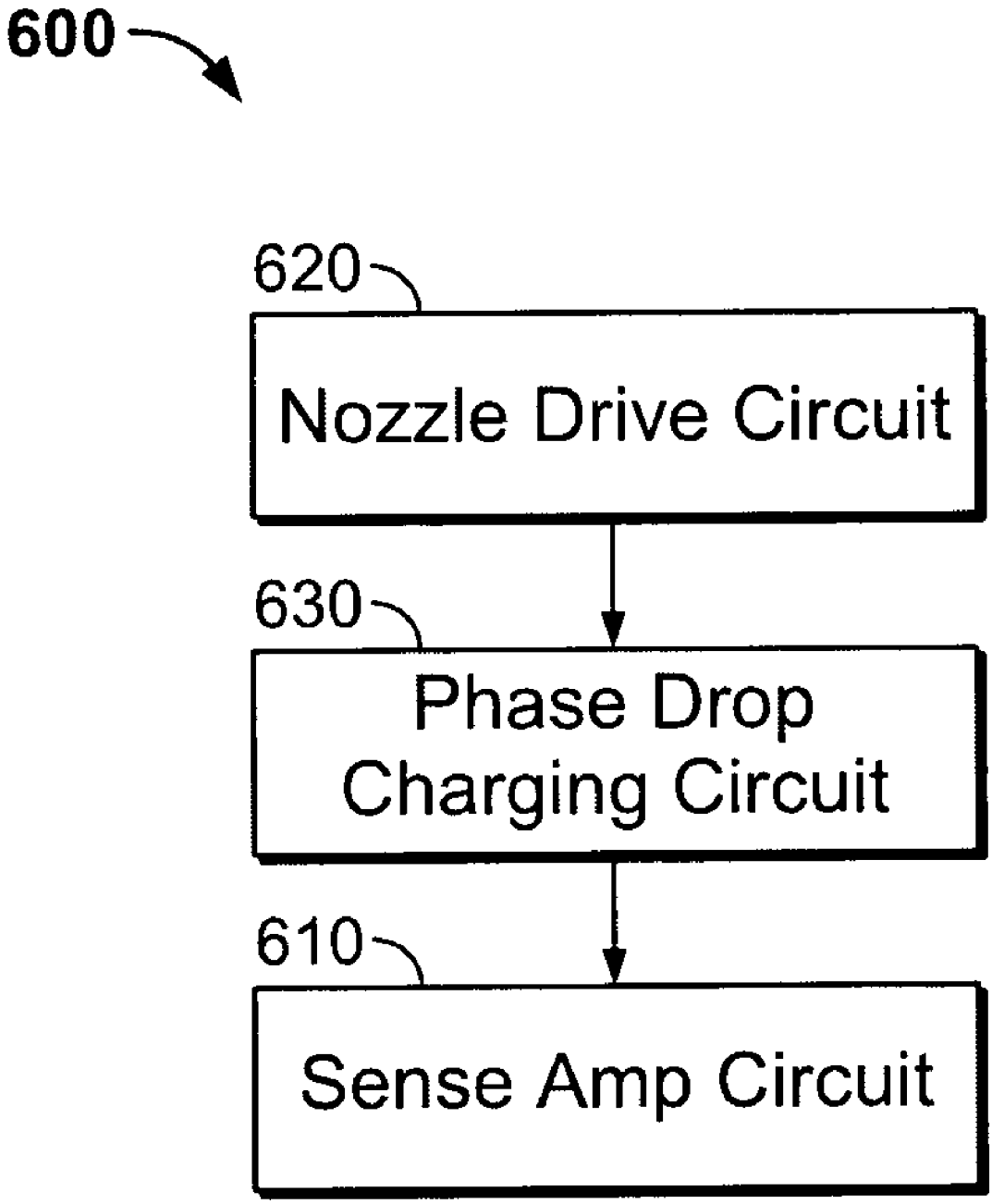
FIG. 6 describes a phasing system used in accordance with an embodiment of the present invention.

FIG. 6 describes a phasing system 600 used in accordance with an embodiment of the present invention. The phasing system 600 includes a sense amp circuit 610, a nozzle drive circuit 620, and a phase drop charging circuit 630.

The sense amp circuit 610 may positioned with respect to the ink catcher 30 and/or the nozzle 6, for example. The sense amp circuit 610 uses a multiple stage amplifier to detect charges on ink drops. The circuit 610 integrates the charges of a burst of drops and produces an output signal. The output signal is then compared to a reference value. If the signal value is greater than the value, a low (e.g., 0 volt) signal is output. If the signal value is less than the fixed value, a high (e.g., 5 volt) signal is output. The value to which the signal is compared may be controlled by an adjustable potentiometer (e.g., set to 0.5 volts).

The nozzle drive circuit 620 controls ink drop break off from an ink stream. An ink drop breaks off or separates from the stream due to a piezoelectric crystal vibrating at a drop clock frequency. A sine wave voltage is applied to the piezoelectric crystal to produce vibration. The sine wave, often referred to as the nozzle drive, is synchronized to a drop clock. The nozzle drive circuit 620 controls an amplitude of the sine wave. By varying the amplitude of the sine wave, a location of ink drop break off may be varied.

The phase drop charging circuit 630 may be controlled by an enable/disable bit, for example. When enabled the phase drop charging circuit 630 operates as follows. The phase drop charging circuit applies a phase voltage to the charge tunnel 10 while a selected phase clock is "high". The phase drop charging circuit removes the phase voltage from the charge tunnel 10 while the clock is "low". The phase voltage applied to the ink drop may be fixed by hardware and/or software. In an embodiment, the phase drop charging circuit 630 may select between four phase clocks. In another embodiment, the phase drop charging circuit 630 may select between 16 phase clocks.

The phasing system times a charged ink drop as the drop passes through the charge tunnel 10. The phasing system uses timing information to adjust the charge signal to optimize a charge placed on a drop. Previously, a threshold was set in hardware at a predefined level to determine how many "good" signals were received in a given time period. Certain embodiments of the present invention provide automatic digital control of a threshold to determine how many "good" phases are detected.

Figure 7:
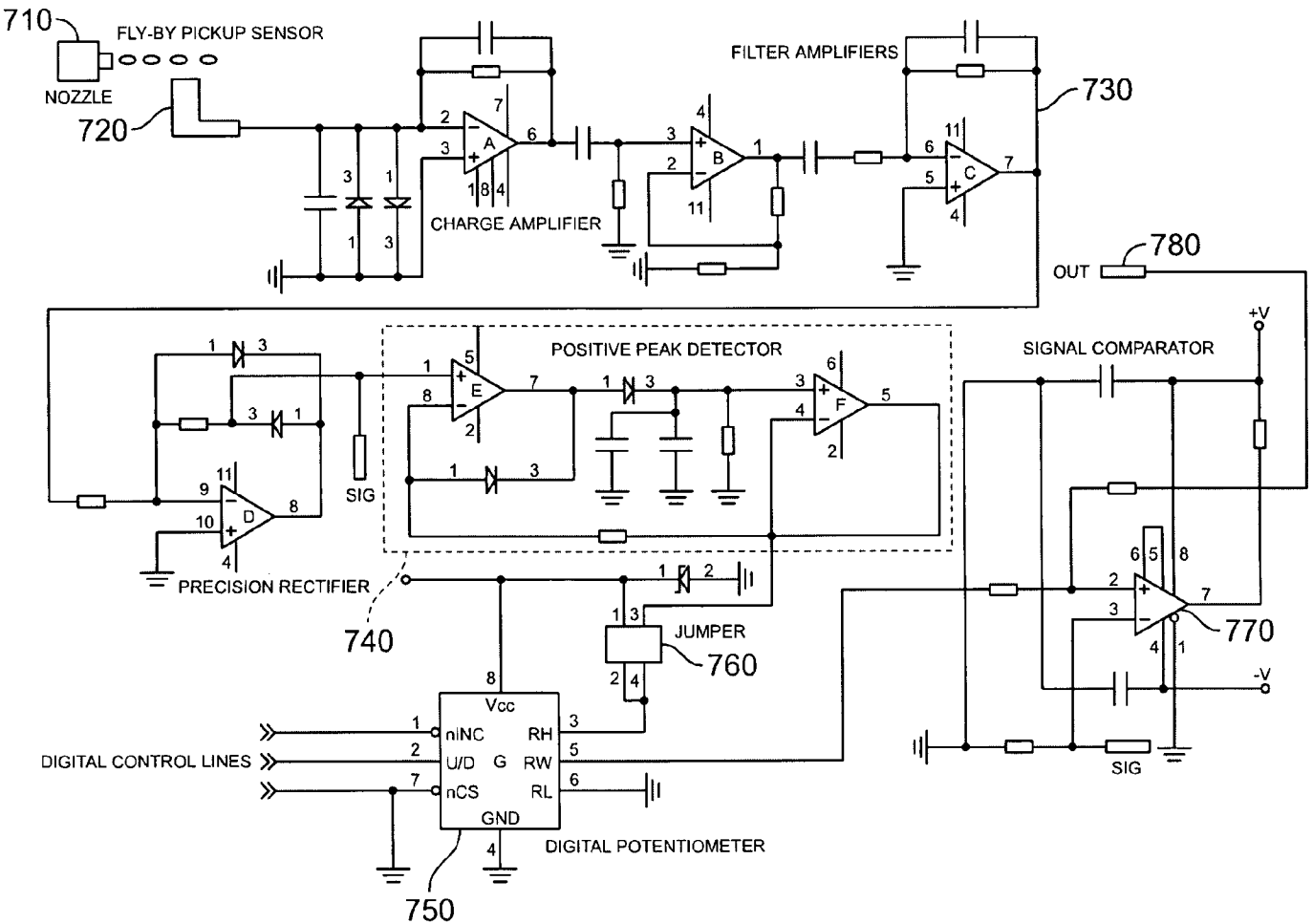
FIG. 7 illustrates a phasing system with adaptive thresholding used in accordance with an embodiment of the present invention.

FIG. 7 illustrates a phasing system 700 with adaptive thresholding used in accordance with an embodiment of the present invention. The phasing system 700 includes a nozzle 710, a fly-by sensor 720, filter electronics 730, a peak detector 740, a digital potentiometer 750, a selector 760, a comparator 770, and an output 780. Ink travels through the nozzle 710 to a charging tunnel (not shown). The nozzle 710 produces ink drops which are charged to certain level(s) for printing. The charged drops pass the fly-by sensor 720 for measurement.

The phasing system 700 may examine individual ink drops or packets of ink drops, depending upon software configuration. Rather than obtaining data from a sensor located at an ink catcher (not shown), the phasing system 700 includes a sensor 720 (referred to as a "fly-by" sensor, for example) positioned with respect to the nozzle 710. The fly-by sensor 720 detects charge on ink drops with a shorter time interval than a catcher sensor due to the decreased distance the charged drop travels from the nozzle 710 until the drop passes the sensor 720. Additionally, it is difficult to identify single ink drops in the catcher, rather than a piece of ink line. The fly-by sensor 720 allows measurement of charge on individual ink drops.

In an embodiment, the fly-by sensor 720 is a capacitive sensor. For example, the sensor 720 may be a capacitive sensor including a plastic outer liner and a metal outer jacket, such as a brass tube, connected to a cable, such as a coaxial cable. The metal portion of the sensor 720 is insulated from ink drops by a coating of epoxy, for example. A coating over the metal sensor prevents ink drops from shorting out the sensor 720. The cable allows data from the sensor 720 to be transmitted for processing. A variety of cables, such as Teflon coaxial cable, low noise coaxial cable, or other cable may be used. In an embodiment, the sensor 720 may be integrated with a print head or other system component to reduce or eliminate the cable. The sensor 720 capacitively couples a charge between an ink drop and the metal plate or tube. Charge information is then transmitted from the sensor 720 for processing by the filter electronics 730, peak detector 740 and/or other system components.

In another embodiment, an additional sensor is located in the ink catcher. The two sensor combination may be used to obtain two sets of charge ratings. The two sensors may also be used to measure a time of travel for an ink drop between the fly-by sensor 720 and the ink catcher sensor. Alternatively, two fly-by sensors maybe fixed at different locations from the nozzle to measure time over distance for an ink drop.

The filter electronics 730 process a signal from the sensor 720 to facilitate more efficient use and analysis of the signal. For example, the filter electronics 730 filter, smooth, and/or amplify the signal from the fly-by sensor 720 to improve the signal quality and usability with the peak detector 740.

The peak detector 740 analyzes the signal from the fly-by sensor 720 to determine peak(s) of the signal. In an embodiment, the peak detector 740 analyzes the signal after it has been filtered by the filter electronics 730. In an embodiment, the peak detector 740 may be integrated with the filter electronics 730 and/or other components of the system 700. The peak detector 740 rectifies the signal (i.e., isolates positive portions of the signal). The detector 740 then detects peaks in the positive portions of the signal indicating charge on ink drops passing the fly-by sensor 720.

Signal peak information is used to set a threshold to isolate "good" charged ink drops. The threshold is used to help the system identify and quantify a number of good drops to provide feedback for charging. Software and/or hardware may be used to process the signal peak information and set the threshold. The threshold is adjusted based on the signal peak information. For example, if less than a certain number of peaks are detected above a threshold, then the threshold is lowered. If more than a certain number of peaks are detected above the threshold, then the threshold is raised. The threshold may be adjusted by a user and/or through software, for example. Adjusting the threshold provides feedback to the printing system. The threshold sets the sensitivity of the printing system. Adjusting the threshold allows the best (e.g., strongest) group of phases to be captured. The printing system may then select which one of those phases the system will use to print.

Threshold information is "stored" in a storage device, such as the digital potentiometer 750. That is, the potentiometer 750 is adjusted to reflect the current threshold signal level. The potentiometer 750 may be adjusted by a user and/or via software.

The selector 760 allows the system (for example, via selection by a user, software and/or hardware) to select between the adjusted threshold value and a predefined reference value. The predefined reference value may be hardwired or selected by software or manually by a user. The predefined reference value may be stored in a potentiometer or in a memory, for example. Thus, the selector 760 allows either the reference threshold value or the dynamically adjusted threshold value to be selected for a comparison to incoming charge phase signals. The selector 760 may be a settable jumper, a multiplexer, or other hardware or software selection device, for example.

The comparator 770 compares a signal coming from the sensor 720 corresponding to charged ink drops with either the adjusted threshold or reference threshold value. The value to which the charge signal is compared is set by the selector 760, as discussed above. If a signal peak value is less than the selected threshold value, then the signal peak value is discarded. If the signal peak value is greater than the selected threshold value, then the signal peak value may be used to determine at which phase ink drops should be charged and printed. A count may be maintained of a number of peaks that are above and below the threshold in order to adjust the adaptive threshold level, as described above. The signal values above the threshold may be transmitted for processing and/or system feedback via the output 780. The signal values may be used to determine when maximum charge may be placed on ink drops, for example. Signal values may be used as feedback to fine tune ink charging and delivery timing, for example.

Figure 8:
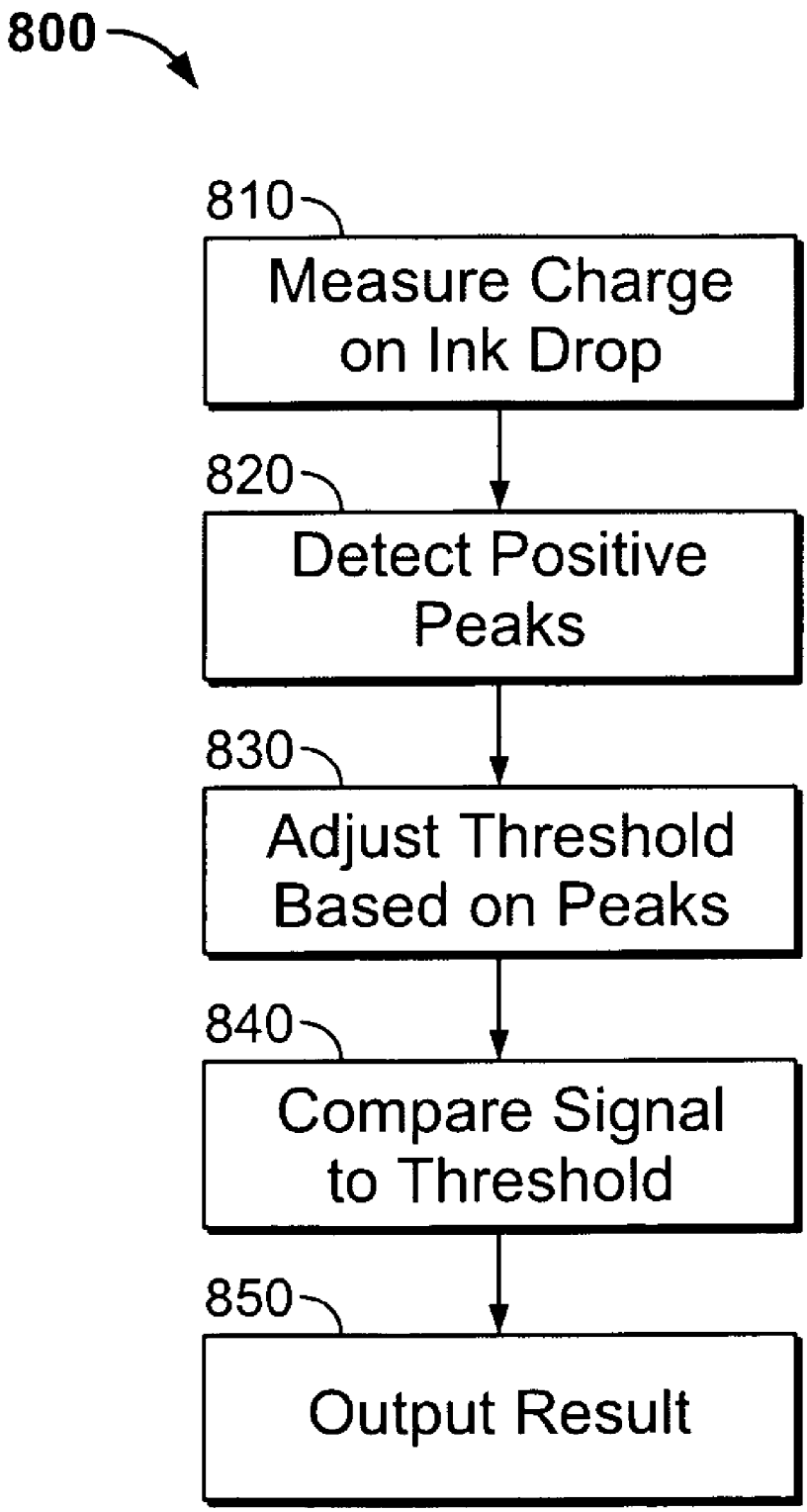
FIG. 8 shows a flow diagram for a method for adaptive phase thresholding used in accordance with an embodiment of the present invention.

FIG. 8 shows a flow diagram for a method 800 for adaptive phase thresholding used in accordance with an embodiment of the present invention. First, at step 810, a sensor measures a charge on an ink drop. Then, at step 820, positive peaks are detected in a signal representing ink drop charge. At step 830, a threshold is adjusted based on the number of positive peaks or phases detected. For example, if fewer than seven phases or peaks are detected above a current threshold, then the threshold is lowered (for example, by one count of a potentiometer). If more than nine phases or peaks are detected above the current threshold, for example, then the threshold is raised.

Next, at step 840, a charge signal is compared to either the adjusted threshold or a stored reference threshold. Then, at step 850, a result of the comparison is output to software and/or hardware in the printing system. The output may be used as feedback to adjust a number of phases used, an amount of charge applied to ink drops, a threshold for phase detection, or other parameter, for example.

In an embodiment, a phasing table is compiled including a plurality of printing phases. A desired phase may be selected from the table and used by system software. Additional phases may be added to the table and/or used for printing. In another embodiment, additional potentiometers may be added to the phasing system to store additional threshold levels for varying levels of comparison.

In an alternative embodiment, adaptive thresholding may be applied to multiple ink jets in a printing system. For example, one ink catcher may be used for multiple ink jets. Multiple sensors may be positioned to obtain data for the multiple ink streams. A multiplexer may be used to route selected data signals to processing logic. Alternatively, separate peak detection and processing logic may be provided for each of the data signals.

In an embodiment, the phasing system and charge detection circuitry may be used to detect satellites, or ink drop fragments that have separated from an ink drop. Detected charge from ink passing a sensor may be used to determine whether satellites have combined with a primary ink drop. For example, a sharp peak is detectable where a satellite has recombined with an ink drop. Recombination data from the charge signal may be used to determine maximum nozzle drive speed for printing. As nozzle drive speed increases, ink drop break-off point changes, and a different phase may be desired for printing. Using signal data from the phasing system, nozzle drive speed and phase may be adjusted to determine a point at which a minimum nozzle drive produces a maximum amplitude.

Thus, certain embodiments of the present invention provide a flexible system involving minimal user intervention and configuration. Certain embodiments accommodate variations in ink type, ink quality, machinery variations, and environment variations, for example. Certain embodiments provide an efficient, inexpensive system and method for improved calibration of a variety of printers without increasing manufacturing or operational tolerances. Certain embodiments provide feedback to dynamically adjust charge thresholds, phasing, timing, and other system parameters to optimize printing. Certain embodiments reduce user setup and automatically adjust for varying conditions. Certain embodiments adapt continuously for temperature, environment, ink quality, and ink type, for example, while operating within a print window. Certain embodiments of the present invention may be used in any system placing charge on ink drops.

While the invention has been described with reference to a preferred embodiment, it will be understood by those skilled in the art that various changes may be made and equivalents may be substituted without departing from the scope of the invention. In addition, many modifications may be made to adapt a particular situation or material to the teachings of the invention without departing from its scope. Therefore, it is intended that the invention not be limited to the particular embodiment disclosed, but that the invention will include all embodiments falling within the scope of the appended claims.

The invention claimed is:

1. An improved phasing system for use with an ink jet printer, said system comprising:

a nozzle for producing ink drops from an ink stream;

a fly-by sensor positioned with respect to said nozzle for measuring charge from said ink drops to generate a charge signal associated with said ink drops;

a peak detector for detecting signal peaks above a charge signal comparison threshold in said charge signal; and a threshold storage device for automatically adjusting said charge signal comparison threshold based on a number of signal peaks detected with respect to said charge signal comparison threshold.

2. The system of claim 1, wherein the threshold storage device stores said threshold.

3. The system of claim 2, wherein said threshold storage device comprises a digital potentiometer.

4. The system of claim 1, further comprising a comparator comparing said charge signal to said threshold.

5. The system of claim 4, wherein said comparator selects between said threshold and a standard reference signal to compare to said charge signal.

6. The system of claim 5, further comprising a selector for selecting between said threshold and said standard reference signal.

7. The system of claim 1, further comprising filter electronics for filtering said charge signal.

8. The system of claim 1, further comprising a second sensor positioned with respect to an ink catcher for measuring charge from said ink drops to generate a second charge signal.

9. A method for adaptive thresholding in an ink jet phasing system, said method comprising:

detecting a charge on at least one ink drop;

generating a charge signal based on said charge on said at least one ink drop, said charge signal corresponding to said charge on said at least one ink drop;

comparing a signal threshold for measurement of charge on said at least one ink drop to said charge signal; and dynamically and automatically adjusting said signal threshold based on said charge signal.

10. The method of claim 9, further comprising measuring peaks in said charge signal.

11. The method of claim 9, further comprising selecting a charge phase for printing based on said signal threshold.

12. The method of claim 9, further comprising storing said signal threshold.

13. The method of claim 9, further comprising selecting between said signal threshold and a reference threshold for comparison to said charge signal.

14. The method of claim 9, further comprising generating a second charge signal based on charge on said at least one ink drop.

15. The method of claim 14, further comprising measuring a time of travel for said at least one ink drop based on said charge signals.

16. The method of claim 9, further comprising determining a point at which a minimum nozzle drive produces a maximum amplitude in said charge signal.

17. A system for dynamic threshold adjustment in a phasing feedback unit, said system comprising:

a sensor for measuring a charge on an ink drop to generate a charge phase signal based on said charge on said ink drop;

a detection unit for dynamically adjusting a signal comparison threshold based on said charge; and a comparator for comparing a charge phase signal to said signal comparison threshold, wherein said detection unit automatically adjusts said signal comparison threshold based on said comparison of said charge phase signal to said signal comparison threshold by said comparator.

18. The system of claim 17, wherein said detection unit selects a phase for charging said ink drop.

19. The system of claim 17, further comprising a plurality of sensors obtaining charge data for said ink drop at a plurality of locations.

* * * * *